US009362604B2

(12) United States Patent
Denis et al.

(10) Patent No.: US 9,362,604 B2
(45) Date of Patent: Jun. 7, 2016

(54) RF PLANAR FILTER HAVING RESONATOR SEGMENTS CONNECTED BY ADJUSTABLE ELECTRICAL LINKS

(75) Inventors: Stephane Denis, La Bouexiere (FR); Gerard Haquet, Chateaubourg (FR); Jean-Pierre Cazenave, Paris (FR)

(73) Assignee: Thales, Courbevoie (FR)

( * ) Notice: Subject to any disclaimer, the term of this patent is extended or adjusted under 35 U.S.C. 154(b) by 0 days.

(21) Appl. No.: 13/983,997

(22) PCT Filed: Feb. 10, 2012

(86) PCT No.: PCT/EP2012/052271
§ 371 (c)(1),
(2), (4) Date: Sep. 10, 2013

(87) PCT Pub. No.: WO2012/107543
PCT Pub. Date: Aug. 16, 2012

(65) Prior Publication Data

US 2014/0159834 A1 Jun. 12, 2014

(30) Foreign Application Priority Data

Feb. 10, 2011 (FR) ..... 11 00408

(51) Int. Cl.
*H01P 1/203* (2006.01)
*H01P 5/02* (2006.01)

(52) U.S. Cl.
CPC ..... *H01P 1/20327* (2013.01); *H01P 1/20336* (2013.01); *H01P 1/20363* (2013.01); *H01P 1/20381* (2013.01); *H01P 5/02* (2013.01)

(58) Field of Classification Search
CPC ..... H01P 1/20327; H01P 1/20363; H01P 1/20381; H01P 1/2039
USPC ..... 333/205, 235
See application file for complete search history.

(56) References Cited

U.S. PATENT DOCUMENTS 5,187,459 A * 2/1993 Russell et al. ..... 333/204
2005/0052262 A1 3/2005 Fukunaga et al.
2005/0140472 A1 6/2005 Ko et al.

FOREIGN PATENT DOCUMENTS

JP 56086501 A 7/1981

OTHER PUBLICATIONS

Jen-Tsai Kuo et al., "Stepped Impedance Resonator Bandpass Filters with Tunable Transmission Zeros and Its Application to Wide Stopband Design", 2002 IEEE MTT-S International Microwave Sumposium Digest (Cat. No. 02CH37278), Jun. 2, 2002, pp. 1613-1616, IEEE, Piscataway, NJ, USA, XP001113914.

(Continued)

*Primary Examiner* — Benny Lee
(74) *Attorney, Agent, or Firm* — Baker & Hostetler LLP

(57) ABSTRACT

An adjustable radiofrequency filter in planar technology comprises at least one dielectric substrate and n resonators R1, R2, . . . Ri, . . . Rj, . . . Rk, . . . Rn integrated into the substrate, and each resonator comprises, on a principal plane PL of the substrate, a succession of segments t1, t2, . . . tq, . . . tp of planar transmission lines each having two ends, p being the number of segments of planar transmission lines of the resonator Ri considered, p being equal to or greater than 2, q being the rank of the segment, an end of a segment tq of a resonator Ri being opposite and separated by a distance d from an end of the next segment t(q+1) of the same resonator Ri, the opposite ends of the successive segments of a resonator Rq being linked by an electrical link which locally raises the characteristic impedance of the resonator Ri considered.

16 Claims, 7 Drawing Sheets

(56) References Cited

OTHER PUBLICATIONS

J. Zhou, et al., "Passive Microwave Filter Tuning Using Bond Wires", Jun. 5, 2007, pp. 567-571, vol. 1, No. 3, XP006028827.

N. Sekiya, et al., "Technique for Tuning Center frequency of HTS Microstrip Filters Without Significantly Changing Bandwidth", Physica C, Oct. 15, 2009, pp. 1653-1657, vol. 469, No. 15-20, North-Holland Publishing, Amsterdam, NL, XP026447637.

* cited by examiner

RF PLANAR FILTER HAVING RESONATOR SEGMENTS CONNECTED BY ADJUSTABLE ELECTRICAL LINKS

CROSS-REFERENCE TO RELATED APPLICATIONS

This application is a National Stage of International patent application PCT/EP2012/052271, filed on Feb. 10, 2012, which claims priority to foreign French patent application No. FR 1100408, filed on Feb. 10, 2011, the disclosures of which are incorporated by reference in their entirety.

FIELD OF THE INVENTION

The invention relates to adjustable radiofrequency filters in planar technology that can be altered to obtain the desired filtering performance.

BACKGROUND

Certain types of radiofrequency (RF) filters operating notably in high-frequency and microwave frequency bands comprise coupled resonators produced on the basis of transmission lines in planar technology.

FIGS. 1, 2 and 3 respectively represent three bandpass planar filters of the prior art.

FIG. 1 represents a planar technology filter reduced to its simplest expression. This filter comprises a half-wave resonator R2 coupled in parallel over half its length with two adjacent quarter-wave resonators R1 and R3.

The resonators R1, R2, R3, are usually produced in microstrip line technology. The filter of FIG. 1 therefore comprises a substrate 8, of thickness h, of dielectric permittivity Er, having a principal face 10 comprising a respective microstrip line for each resonator and a metallized face 12 opposite from the principal face 10 to form a ground plane or principal plane PL.

In a known manner, the person skilled in the art knows how to calculate the respective physical dimensions of the microstrip lines, their length and the distance separating these lines so as to obtain the desired characteristics of the filter notably, the passband, the impedances at the ports of the filter, the attenuated frequency band or other parameters of the filter. In this type of filter, the tuning of the central frequency of the resonator R2 of FIG. 1 is obtained principally by changing the length of the microstrip line of which it is constituted.

The resonators R1 and R3 are respectively connected to the ports A1, A2 (shown in FIGS. 2 and 3, for example) of the filter by a respective line L1 and L2 (shown in FIGS. 2 and 3, for example) of standard characteristic input and output impedance of filters, i.e., customarily 50 Ω.

FIGS. 2 and 3 show two other types of filters reduced to their simplest expression in planar technology, also comprising three resonators R1, R2, R3.

The filter of FIG. 2 is of interdigital type. One of the ends e2 of the resonator R2 is grounded (zero impedance).

The filter of FIG. 3 is of comb type and also comprises three quarter-wave resonators R1, R2, R3. One of the ends e1, e2, e3 of the three resonators R1, R2, R3 is grounded.

The filter of FIG. 3 makes it possible to obtain very narrow passbands, and the filters of FIGS. 1 and 2, make it possible to obtain wider (or moderate) passbands. These filters are often electrically symmetric, in this case the ports A1 and A2 are interchangeable.

Nonetheless, these types of filters of the prior art are constrained by the tolerances of the elements of which they are constituted. Their principal electrical characteristics, for example their passband, cutoff frequency, losses in the passband, attenuated band or other essential parameters depend greatly on the characteristics of the substrate used to produce the lines of the filter whose thickness, permittivity, permeability, may vary from one filter to another, but also by the tolerances of the fabrication methods such as the precise details of etching of the lines, of producing the vias, of superposition of multiple dielectric layers of the substrate, in the case where multilayer substrates are used.

These variable parameters can lead to efficiencies of fabrication of filters that are inadequate or too random, in the following cases and notably in their combinations:

filters integrated into structures of multilayer substrates notably in the case where these filters are integrated into a consequential monolithic sub-system. An out-of-specification filter then implies that the whole of the sub-system must be scrapped. When several filters are integrated into one and the same module then the problem of efficiency is still more critical, filters which exhibit very close cutoff frequencies or transmission zeros ZT, for example, bandpass filter with low passband and/or low stop band, simple or multiple, filters comprising vias, which is often the case, for example, with filters consisting of resonators with an end short-circuited to ground, compact filters produced with substrates having high permittivity and/or high permeability, and which are particularly sensitive to production tolerances and to electrical parameters such as the dielectric permittivity and the magnetic permeability, systems comprising filters making it necessary to adjust them in their context of use, multiplexer filters.

To improve or guarantee a minimum efficiency of fabrication of prior art planar technology filters, designers and/or fabricators currently resort to the following techniques or processes:

According to a first process the filters are produced and characterized individually, away from the systems for which they are intended. The filters are produced in a technology identical to that of the system, for example on organic substrates, or otherwise when involving complex hybrid integrated systems in or around a stack of substrates.

Another process for guaranteeing the performance of filters consists in performing a characterization and a drastic selection of the substrates and other materials optionally used in an assemblage (for example pre-pregs), in a range of values which are lower relative to those which are proposed by fabricators.

However, precise measurements of permittivity and/or permeability of the materials used to produce the substrates are expensive and complex to carry out. On heterogeneous or indeed anisotropic materials stacks (electric permittivity tensor and magnetic permeability tensor) this characterization is still more complex to carry out. Moreover, if the materials fabricator does not adequately control the properties of the fabricator's materials then it is uncertain that the required quantity of materials with the appropriate characteristics to produce the filters will be available.

Another process consists in pre-characterizing the substrates in terms of thickness and dielectric permittivity, and then in performing a design suited to each different batch. This is expensive and lengthy to put in place due to the masks for thin layers and silk-screen printing screens for thick layers that need to be remade for each batch.

According to another process, in the particular case of filters produced by etching, the etching is controlled so as to alter the performance of the filters. This technique poses production quality problems since the result of the etching exhibits a defect rate, notably through overhangs and irregularities of the edges of tracks, which is aggravated when the nominal duration of etching is not complied with. This process does not allow separate adjustment of the cutoff frequencies and of the frequency response, for example, the separate adjustment of the center of a frequency pass or stop band and of the width of this frequency band. Moreover this process cannot be applied to buried filters.

According to another process, in certain cases it is possible to adjust the response of a filter through small cuts in the lines, for example with a laser. This technique is not possible with all substrates, and is very difficult to implement on substrates of organic type. This technique cannot be carried out on buried filters.

Another process consists in introducing adjustment elements physically on the filter. These adjustment elements are generally pre-connected conducting tags, the adjustment then being performed, either by shortening, that is to say by cutting the tie with the tag or by lengthening the structure by laying a link with the tag. This type of adjustment does not allow fine adjustments since the variations are significant and do not allow a large number of possibilities, notably for compact and/or high-frequency applications since the dimensions of the adjustment elements are limited in terms of minimum dimension, by the fabrication technologies. These elements can be metallic strips laid on the lines. This technique exhibits some randomness related to the difficulty in controlling the shape of a strip which exhibits one or more free ends.

According to some techniques, these elements consist of elements of appropriate dielectric constant, added to the filter to alter its response. These elements entail, for example, (metallized or non-metallized) dielectric pads typically placed in two ways depending on the objective sought: Pads placed at the open-circuit ends of lines/resonators/stubs so as to act on the central frequency, or else between coupled lines so as to act on the pass or stop band width or on transmission zeros ZT obtained by couplings between non-adjacent resonators. This category of adjustment elements allows fine variations of the response of the filter. On the other hand, it is expensive to lay these elements on the substrate and the adjustment amplitudes are low.

There also exist techniques of filter adjustment with the aid of mechanical elements such as systems employing screws or adjustable plungers, which are unwieldy, cumbersome and poorly suited to large production volumes.

Other techniques for adjusting the filters of the prior art resort to electronic means which allow dynamic adjustment of the filter but exhibit drawbacks and require an ancillary control device. These devices which generate control currents or voltages are expensive and cumbersome.

Some techniques for adjusting filters may include the use:

of varactor diodes or MEMS varactors (the initials standing for "Micro Machined Electro Mechanical System") comprising the drawback of a low power rating.

of ferromagnetic elements whose magnetic permeability μr is controlled by a controlling exterior magnetic field. The drawback of this type of filter adjustment is significant consumption and significant bulkiness of the control system.

of ferroelectric elements and liquid crystals, whose dielectric permittivity Er varies as a function of a controlling external electric field. This method of fabrication is expensive and difficult to control, requires a high control voltage, exhibits a low coefficient of quality and low power rating.

of switching elements, of PIN diode or MESFET (MEtal Semiconductor Field Effect Transistor) or CMOS (Complementary Metal Oxide Semiconductor) transistor type, reserved for filters working at low frequencies exhibiting a large bulk and a low coefficient of quality.

These techniques for adjusting filters usually generate lower-performance filters notably, in terms of power rating, coefficient of quality, insertion losses, rejection, than fixed analogous structures with no electronic adjustment device.

SUMMARY OF THE INVENTION

To alleviate the drawbacks of the radiofrequency filters of the prior art, the invention proposes an adjustable radiofrequency filter in planar technology comprising a dielectric substrate and n resonators R1, R2, . . . Ri, . . . Rj, . . . Rk, . . . Rn integrated into the substrate.

The resonators R1, R2, . . . Ri, . . . Rj, . . . Rk, . . . Rn are characterized in that each resonator comprises, on a principal plane PL of the substrate, a succession of referenced segments t1, t2, . . . tq, . . . tp of planar transmission lines each having two ends, p being the number of segments of planar transmission lines of the resonator Ri considered, p being equal to or greater than 2, q being the reference to the segment, an end of a segment tq of a resonator Ri being opposite and separated by a distance d from an end of the next segment t(q+1) of the same resonator Ri, the opposite ends of the successive segments of a resonator Ri being linked by an electrical link which locally raises the characteristic impedance of the resonator Ri considered.

Advantageously, the electrical link between two successive segments of transmission lines tq, t(q+1) of the resonators R1, R2, . . . Ri, . . . Rj, . . . Rk, . . . Rn is a planar transmission HI line of greater characteristic impedance than the characteristic impedance of the resonator Ri considered.

In an embodiment of the planar filter according to the invention, the length of the planar transmission HI line is larger than the distance d between the opposite ends of two successive segments of transmission lines tq, t(q+1) so as to increase the electric length of the resonators R1, R2, . . . Ri, . . . Rj, . . . Rk, . . . Rn.

In another embodiment, the electrical link between successive segments of transmission lines comprises at least one bonding wire in a plane P perpendicular to the principal plane PL of the substrate.

In another embodiment, the electrical link between two successive segments of transmission lines tq, t(q+1) of the resonators R1, R2, . . . Ri, . . . Rj, . . . Rk, . . . Rn comprises several bonding wires in parallel, each wire being in a respective plane perpendicular to the principal plane PL.

In another embodiment, the ends linked by a bonding wire of two successive segments of lines tq, t(q+1) of a resonator Rj are in proximity to the ends of two other successive segments of transmission lines linked by another bonding wire of another resonator Rk in such a way that the surfaces formed by the bonding wires of the two said resonators Rj and Rk with the principal plane PL are facing one another in order to obtain a coupling between the two resonators Rj and Rk.

In another embodiment, the substrate comprises several layers, the principal plane PL comprising the segments of transmission lines of the resonators being between at least two superposed layers.

The invention also relates to a method for adjusting the adjustable filter according to the invention in planar technology comprising a dielectric substrate and n resonators R1, R2, . . . Ri, . . . Rj, . . . Rk, . . . Rn integrated into the substrate, each resonator comprising, on a principal plane PL of the substrate, a succession of segments t1, t2, . . . tq, . . . tp of planar transmission lines each having two ends, p being the number of segments of planar transmission lines of the resonator Ri considered, p being equal to or greater than 2, q being the rank of the segment, an end of a segment tq of a resonator Ri being opposite and separated by a distance d from an end of the next segment t(q+1) of the same resonator Ri, the opposite ends of the successive segments of a resonator Rq being linked by a planar transmission HI line (30, 34) intended to locally raise the characteristic impedance of the resonator Ri considered.

The method comprises at least one step of bonding, between the opposite ends of two successive segments of lines tq, t(q+1) to the terminals of the planar transmission HI lines, of at least one bonding wire, in a plane P perpendicular to the principal plane PL of the substrate, the lengths of the bonding wires and their points of connection on the end of the segments of transmission lines having been previously determined so as to obtain the desired resonant frequency of the resonators.

In an implementation of the method of adjustment, the adjustable filter being a bandpass filter comprising at least one resonator Rj and one resonator Rk, the resonator Rj having the opposite ends of two consecutive segments of transmission lines tq, t(q+1) linked by a bonding wire in proximity to the ends of two other consecutive segments of transmission line of the other resonator Rk linked by another bonding wire, in such a way that the surfaces formed by bonding wires with the principal plane PL of the two said resonators Rj and Rk are facing one another, the method of adjustment consisting in modifying the distance and the position between one and the other bonding wire of the respective resonators Rj and Rk so as to obtain, by modifying the coupling between the resonator Rj and the resonator Rk, the desired passband.

The principal filters aimed at by this invention consist of parallel lines coupled with half-wave resonators coupled in parallel or else with quarter-wave comb (low passband) and/or inter-digital (with wide passband) resonators.

This technique for producing and adjusting planar filters according to the invention also applies:

to filters with transmission zeros or ZT, notably when these transmission zeros are obtained by couplings between non-adjacent resonators.

to filters consisting of line segments terminated in open circuit or in short-circuit or "stubs".

All the frequency responses of the radiofrequency filters according to the invention are conceivable, including: bandpass, low-pass, high-pass, band rejection, or other responses, and likewise all the approximation functions are also relevant, such as: Butterworth, Chebyshev, Bessel, Elliptic, etc.

The description of exemplary embodiments of filters according to the invention is done for bandpass filters and in microstrip line technology, but the invention applies in a similar manner to other types of frequency responses and to other types of embodiments of the lines.

The technologies for producing the resonators of the filters can be those of microstrip lines or of planar lines, produced in a conventional manner on a single substrate either integrated into a stack of substrates or produced on a suspended substrate.

This technique also applies to impedance matching functions and amplitude and/or phase correction functions, sometimes called linearizers, in microwave frequency electronic circuits.

BRIEF DESCRIPTION OF THE DRAWINGS

The invention will be better understood with the aid of exemplary embodiments of planar technology microwave frequency filters described with reference to the indexed figures in which.

Like reference numerals between the various figures refer to same or similar elements.

DETAILED DESCRIPTION OF THE INVENTION

Hereinafter are described exemplary embodiments of planar filters and their method of adjustment according to the invention.

Figure 1:
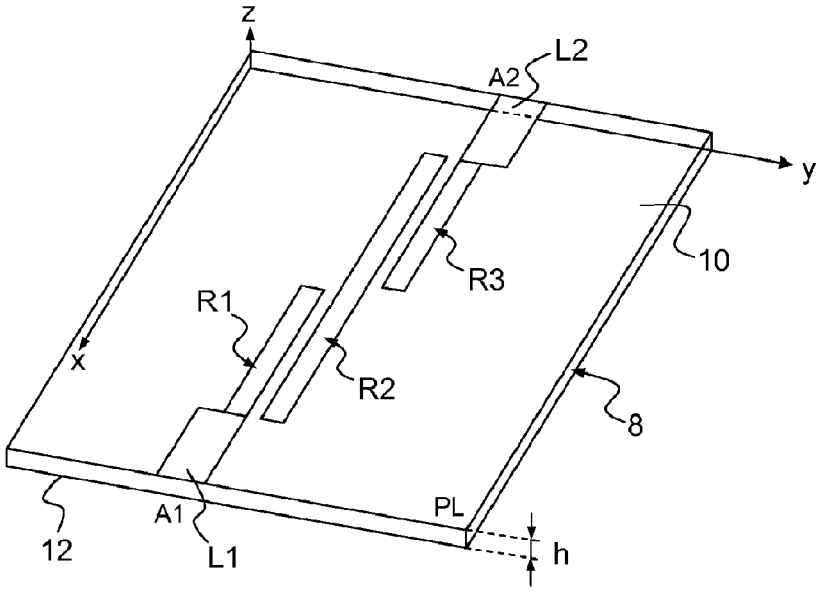
FIG.1 (PRIOR ART)
FIGS. 1, 2 and 3 respectively represent three coplanar filters of the prior art comprising three coupled resonators.
Figure 4A:
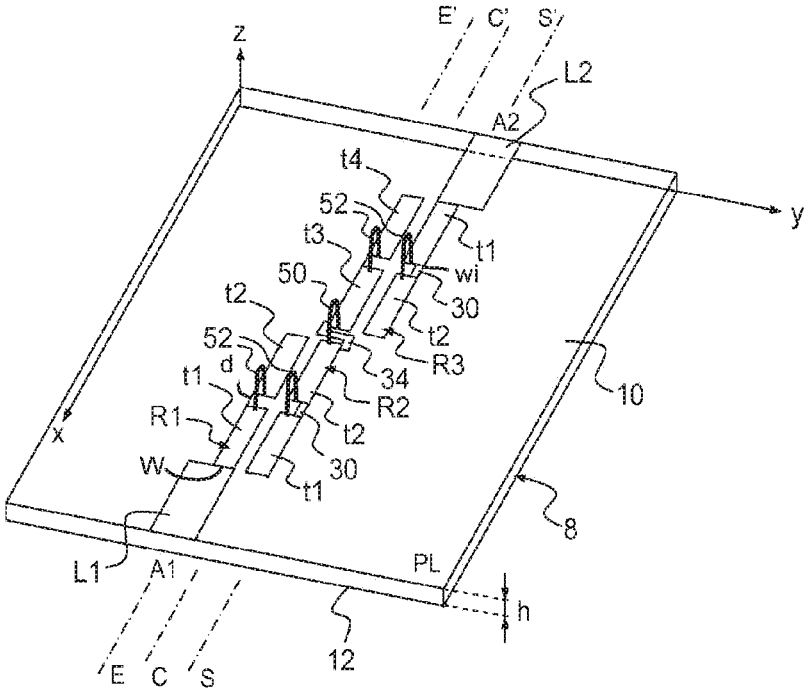
FIG. 4*a*, shows an adjustable filter according to the invention having the same structure as the filter of FIG. 1.

FIG. 4*a*, shows an adjustable filter according to the invention having the same structure as the filter of FIG. 1.

The filter of FIG. 4*a* according to the invention comprises a half-wave resonator R2 coupled in parallel over half its length with two adjacent quarter-wave resonators, a resonator R1 linked by the line L1 to the port A1 of the filter and a resonator R3 linked by the line L2 to the port A2 of the filter. The three resonator R1, R2, R3 are produced in the form of microstrip lines on a dielectric substrate of thickness h.

According to a principal characteristic of the planar filter according to the invention the resonator R1 and the resonator R3 each comprise two segments t1, t2 of microstrip transmission lines of like characteristic impedance Zc and widths W, two segments of one and the same resonator being linked by a respective HI microstrip line 30 (HI for High Impedance), of lesser width wi than the width W of the segments of line t1, t2. The impedance of the HI line 30 is of much higher value than the impedance Z1 of the segments of line t1, t2.

Figure 4B:
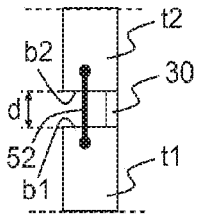
FIG. 4*b* shows a partial end-on view of the resonator R3 of the filter of FIG. 4*a;*

FIG. 4*b* shows a partial end-on view of the resonator R3 of the filter of FIG. 4*a*.

Figure 3:
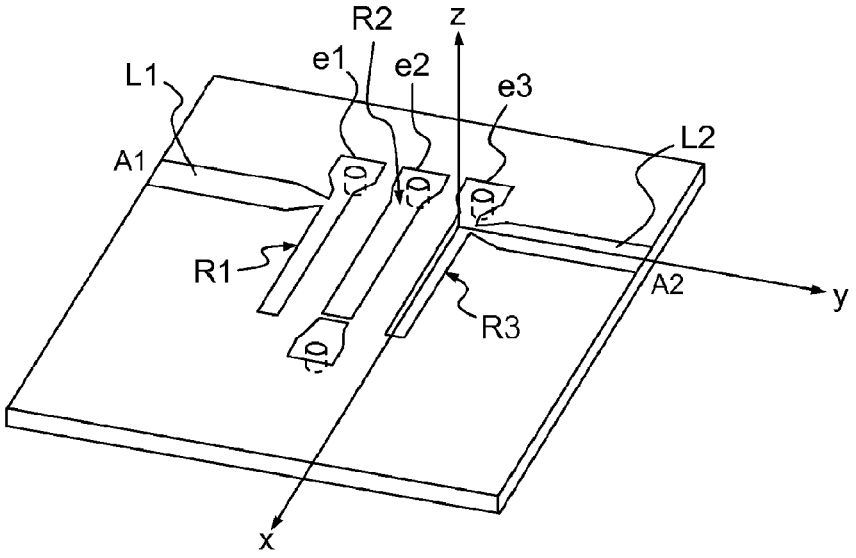
FIG.3 (PRIOR ART)

The two segments of line t1, t2 and the HI microstrip line 30 of the resonators R1 and R3, as depicted in FIG. 3, are aligned along respective axes EE', SS' parallel to the axis X of a coordinate system XYZ (shown as X, Y, Z axes). The opposite edges b1, b2 of the segments of line are separated by a distance d.

Returning to FIG. 4*a*, the half-wave resonator R2, between the resonator R1 and the resonator R3, comprises four segments of line t1, t2, t3 and t4 aligned along an axis CC' parallel to the axes EE', SS'. The successive segments t1, t2 on one side of the resonator R2 and the successive segments t3 and t4 on the other side of the same resonator R2 are linked by a HI microstrip line 30 of width wi. The successive segments t2, t3, in the central part of the resonator R2 are, for their part, linked by another Hi line 34 of much smaller width wi than the width of the line of the resonator R2. The other Hi line 34 between the segments t2 and t3 of the resonator R2 is of greater length than the distance d separating the opposite edges of the segments t2 and t3 of said resonator R2. For this purpose the other Hi line 34 is in the form of an S comprising a central part 40 (FIG. 4*c*) perpendicular to the axis CC' of the resonator R2.

Figure 4C:
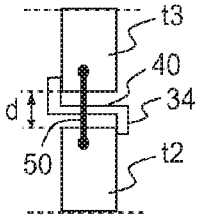
FIG. 4*c* shows a partial end-on view of the resonator R2 of the filter of FIG. 4*a;*

FIG. 4*c* shows a partial end-on view of the resonator R2 of the filter of FIG. 4*a*.

The HI lines 30 and the other HI line 34 create physically at the level of their location between the portions of transmission lines a constriction of the resonators and consequently an impedance break in the resonator.

The central frequency f0 of the bandpass filter of FIG. 4*a* is principally related to the electric length of the resonator R2.

The method for adjusting the filter of FIG. 4*a* comprises at least one step of bonding, between the opposite ends of the segments of lines of the three resonators R1, R2, R3 of an adjustment element ER, which is, in this embodiment, a bonding wire 50, 52 in planes perpendicular to the principal plane PL of the substrate.

More precisely, first bonding wires 50 ensure the electrical connection between segments of lines with no coupling between resonators. Second bonding wires 52 ensure through their disposition in the resonators, in addition to the electrical connection between segments of lines, some coupling between resonators.

The lengths of the bonding wires 50, 52 and their point of connection on the ends of segments of lines are adjusted so as to obtain the desired central frequency f0.

Figure 4D:
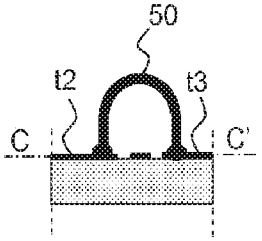
FIG. 4*d* shows a cross-sectional detail view of the resonator R2 of the filter of FIG. 4*a;*

FIG. 4*d* shows a cross-sectional detail view of the resonator R2 showing the first bonding wire 50 welded between the ends of the two segments t2, t3 in the central part of the resonator R2.

In the filter of FIG. 4*a*, the segments of lines t1, t2 are produced in such a way that the HI lines 30 of the resonators R1 and R2 are situated opposite one another. In the same manner the segments t3, t4 of the resonator R2 and the segments t1, t2 of the resonator R3 are produced in such a way that the HI lines 30 are also situated opposite one another. Second bonding wires 52 welded in parallel with the HI lines 30 will allow modification of the coupling between resonators by altering their relative position or their proximity. Modification of this coupling will allow the alteration, in the case of the filter of FIG. 4*a*, of its passband in a manner that is relatively independent of the alteration of its central frequency f0 through the alteration of the lengths of the first 50 and second 52 bonding wires.

In a general manner, in the course of the adjustment of the filters according to the invention, several adjustment elements ER in the form of bonding wires and/or micro-wired conducting strips will be able to be placed in parallel with the HI high impedance lines 30, 34. These elements of fixed or variable length whose length and optionally, if possible, position will be varied so as to adjust a coupling.

In comparison with the bonding wires, the strips make it possible to obtain better coefficients of quality and to support higher powers. On the other hand, the automatic laying of strips is less widespread than the automatic laying of bonding wires.

Figure 2:
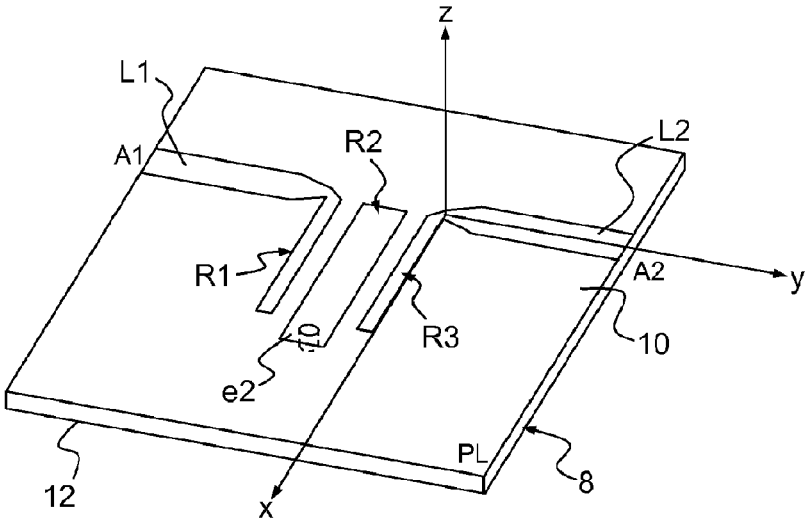
FIG.2 (PRIOR ART)

Specifically, in a general manner, whatever the type of conventional filter such as for example are represented in FIGS. 1, 2 and 3, this entails producing at least one constriction of the resonators R1, R2, . . . Ri, . . . Rj, . . . Rk, . . . . . Rn over a small length so as to locally raise the characteristic impedance through the HI (High Impedance) lines 30, 34 placed between the segments t1, t2, . . . tq, . . . tp of the resonators and thus lengthen their electric length.

The length of the high impedance HI lines 30, 34 depends on the correction amplitude sought on the parameters of the filter. To obtain a sufficient amplitude of adjustment by lengthening or shortening the adjustment element ER 50, 52 (bonding wires) it is necessary to arrange or fold this HI line to obtain points joining the adjustment element ER with the segments of lines that are as close as possible.

For example, the constriction of the resonators R1, R2, R3 of the bandpass filter of FIG. 4*a* through the incorporation of the high impedance HI lines 30, 34 between the segments t1, t2, t3, t4 of transmission lines and adjustment elements ER 50, 52 modifies the response of the original filter such as represented in FIG. 1 and it is therefore necessary to optimize the whole of the structure of the filter to ensure an optimal frequency response in the nominal adjustment position.

Figure 5:
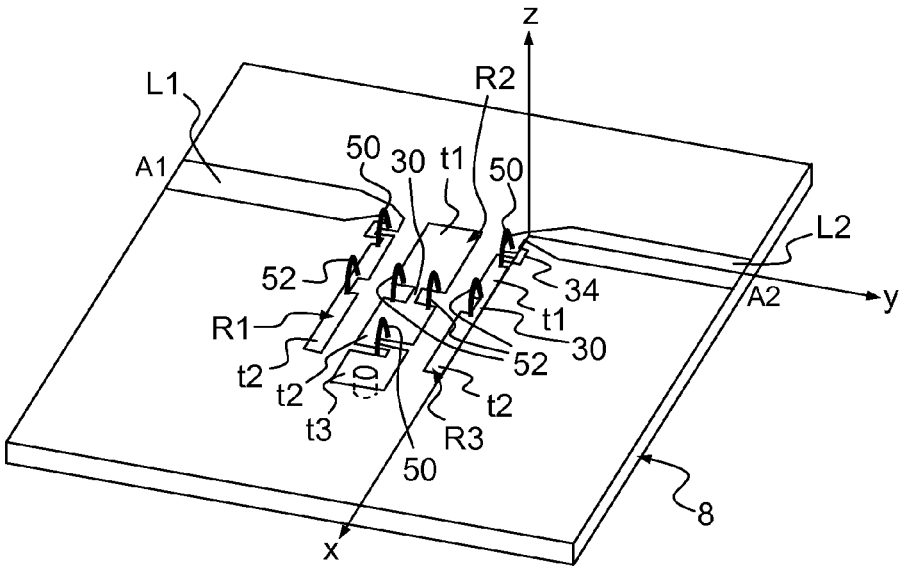
FIG. 5, shows an adjustable filter according to the invention having the same structure as the filter of FIG. 2.
Figure 6:
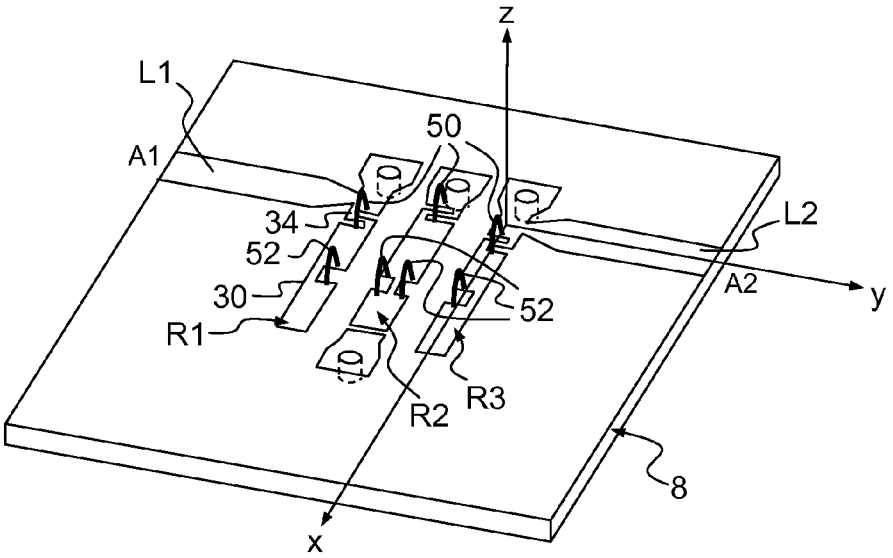
FIG. 6, shows an adjustable filter according to the invention having the same structure as the filter of FIG. 3.

FIG. 5, shows an adjustable filter according to the invention having the same structure as the filter of FIG. 2;

FIG. 6, shows an adjustable filter according to the invention having the same structure as the filter of FIG. 3.

The filters of FIGS. 5 and 6 comprise according to the invention segments of microstrip lines, two segments t1, t2, and t3 in FIG. 5 per resonator R1, R2, R3 linked by one HI line 30, in FIG. 5 for example, and another HI line 34, first bonding wires 50 in parallel with the other HI lines 34 and second bonding wires 52 in parallel with the HI lines 30. The second bonding wires 52 ensure some coupling between resonators.

The planar filters according to the invention can be produced so as to obtain mutually uncoupled adjustment elements (first bonding wires 50), that is to say that are far apart and/or oriented with little surface area facing one another, or/and coupled adjustment elements (second bonding wires 52).

The uncoupled adjustment elements (first bonding wires 50) are used to act predominantly on the central frequency f0 of the filter. Such is for example the case for the first connection bonding wires 50 of FIGS. 4*a*, 5, 6, 8*a* and 9*a*. Here the objective is to find an implementation of the adjustment which hardly influences the passband.

The mutually coupled adjustment elements (second bonding wires 52), that is to say that are close together and oriented with their surfaces facing one another, are used to act on the passband as is the case for the second bonding wires 52 of FIGS. 4*a*, 5, 6, 7, 8*a* and 9*a*.

It is possible to adjust at the same time the central frequency f0 of the filter and its passband Bp solely with coupled adjustment elements (second bonding wires 52), by modifying their length and their relative position on the ends of the segments of lines. This leads to a simpler structure but the adjustments are more limited and more complex to implement.

In general, it is necessary to optimize the structure of the adjustable filter according to the invention to obtain the least correlated possible adjustments of the central frequency f0 and of the passband Bp and an appropriate amplitude of adjustment. This optimization depends on the expected performance in terms of production as a function of the possible variations of the element parameters constituting the filter and of the needs of the application (specifications).

The adjustment of the transmission zeros ZT of the planar filter is similar in its implementation to the adjustments of the central frequency f0 and the passband Bp, through the characteristic and the position of the adjustment elements ER and of the HI lines in the resonators. In this case, the coupled adjustment elements ER 54 are situated in the zones of the resonators which substantially modify the transmission zeros ZT.

Figure 7:
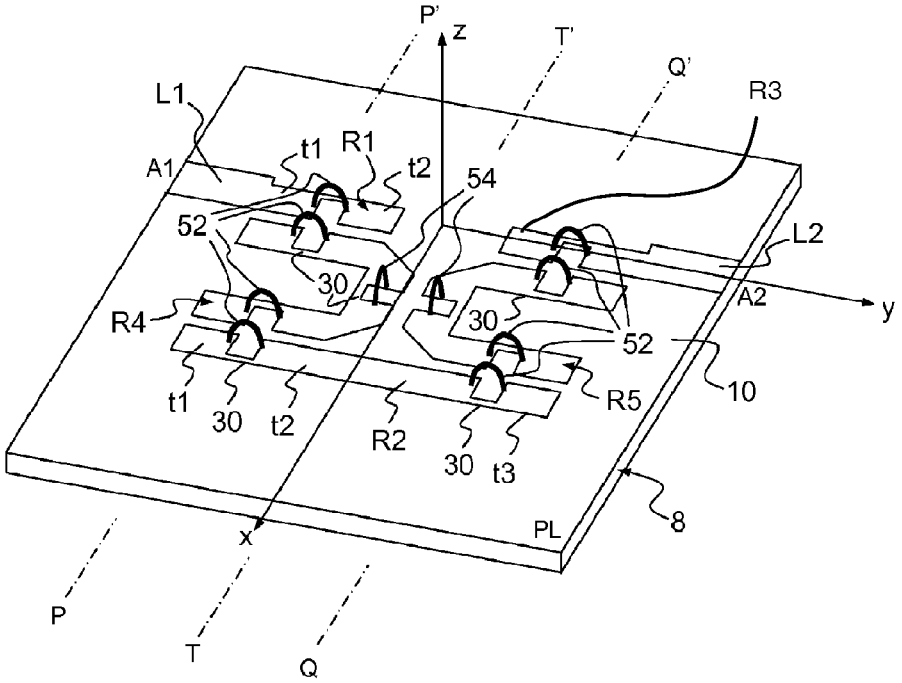
FIG. 7 shows an exemplary embodiment of a bandpass filter according to the invention comprising adjustments on the transmission zeros.

FIG. 7 shows an exemplary embodiment of a bandpass filter according to the invention comprising adjustments on the transmission zeros ZT.

The filter of FIG. 7 comprises 2 resonators R1 and R3 of quarter-wave type and 3 resonators R4, R2, R5 of half-wave type. These resonators are considered adjacent and directly mutually coupled in the order R1/R4/R2/R5/R3. The resonators R4 and R5 are considered non-adjacent and intentionally coupled at their center so as to generate transmission zeros ZT. This particular coupling is called transverse coupling. In its most usual form, the filter exhibits an axis of symmetry TT'.

The resonator R1 and the resonator R3 each comprise two segments t1, t2 of lines, the resonator R2 three segments t1, t2, t3 of transmission lines, the non-adjacent resonators R4, R5 four segments of line each t1, t2, t3, t4.

HI lines 30 linking the segments of the resonators R1, R4, R2 are aligned preferably with one and the same axis PP' parallel to the axis of symmetry TT' of the filter, second bonding wires 52 are welded in parallel with these HI lines 30 to obtain a coupling between these resonators. The bonding configuration is symmetric on the other side of the axis TT' on an axis of alignment QQ' of the HI lines of the resonators R3, R5, R2.

The configuration of the filter of FIG. 7 is such that the centers of the resonators R4 and R5 comprise HI lines 30 and third bonding wires 54 forming surfaces parallel with the principal plane PL according to a plane parallel to the plane XY of the coordinate system XYZ. It is these couplings at the level of the centers of the resonators R4 and R5 which involve the transmission zeros ZT of the filter of FIG. 7 and the possibility of adjusting said transmission zeros.

In the case of production of the planar filters according to the invention, it is possible to use a wire or a conducting strip in place of one 30 or the other 34 microstrip HI line in the resonators to produce a higher impedance. In certain cases, this leads to lower losses. On the other hand, this does not make it possible to simply pre-visualize the response of the filter by a measurement before the bonding wires 50, 52, 54 are put in place. The latter implementation may require two bonding phases, this not being optimal from an industrial point of view.

In certain, so-called integrated, embodiments of filters according to the invention the substrate is a multilayer substrate comprising the segments t1, t2, . . . tq, . . . tp of transmission lines, integrated between at least two layers and therefore not accessible on the surface from outside the filter. In this case, the substrate comprises metallized holes at the level of the ends of the segments of transmission lines linking metallized patches on the surface of the substrate. Electrical linking by bonding wires 50, 52, 54 and/or by HI lines 30, 34 can then be carried out on these metallized patches.

Figure 8A:
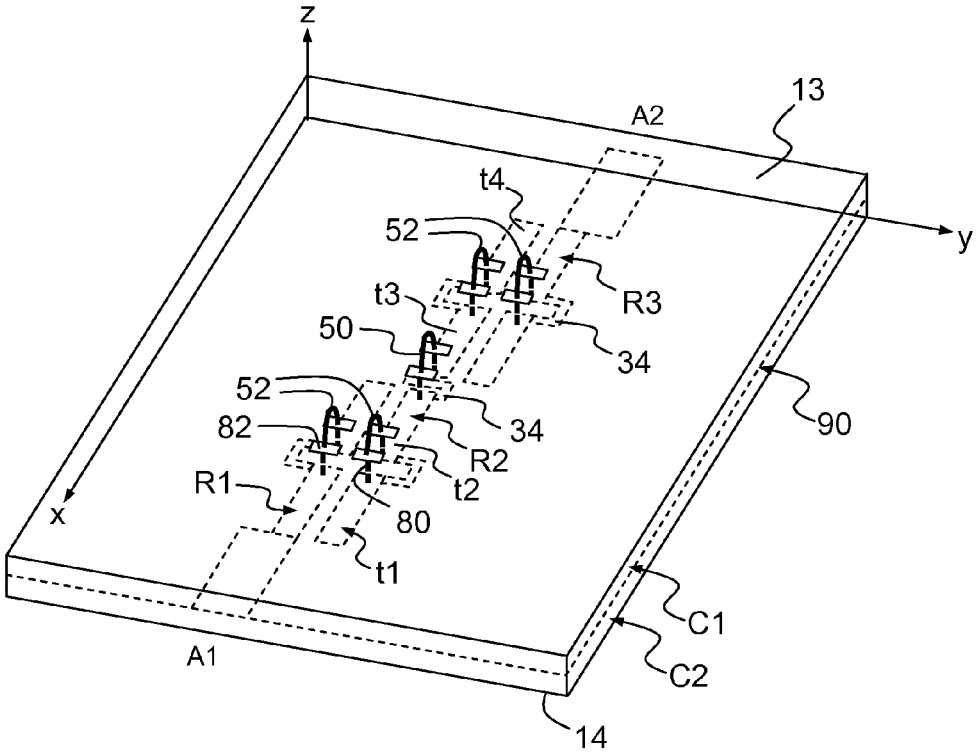
FIG. 8*a*, shows a variant embodiment of an adjustable filter according to the invention of the same structure as the filter of FIG. 1.

FIG. 8*a*, shows a variant embodiment of an adjustable filter according to the invention having the same structure as the filter of FIG. 1.

Figure 8B:
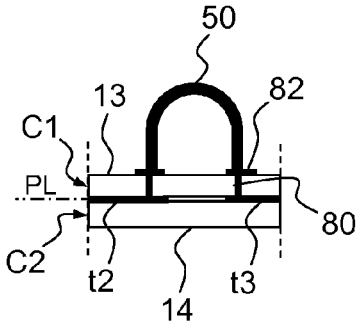
FIG. 8*b* shows a cross-sectional partial view at the level of the central part of the resonator R2 of the filter of FIG. 8*a;*

FIG. 8*b* shows a cross-sectional partial view at the level of the central part of the resonator R2 of the filter of FIG. 8*a*.

Figure 8C:
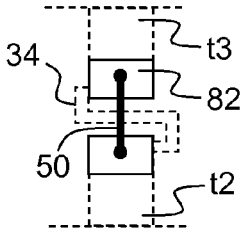
FIG. 8*c* shows a plan view at the level of the central part of the resonator R2 of the filter of FIG. 8*a;*

FIG. 8*c* shows a plan view at the level of the central part of the resonator R2 of the filter of FIG. 8*a*.

The filter of FIG. 8*a* comprises a multilayer substrate 90 having two superposed layers C1, C2 and, buried between these two layers C1, C2, segments of lines t1, t2, t3, t4 and other HI lines 34 linking these segments to form the resonators R1, R2 and R3.

The multilayer substrate comprises an upper face 13 and an opposite lower face 14 which is metallized. The upper face 13 comprises metallized patches 82 linked by metallized holes 80 in the layer C1 to the ends of segments of transmission lines buried in the substrate 90. The adjustment elements, i.e., bonding wires 50, 52 are fixed on these metallized patches 82 on the upper face 13 of the substrate 90.

The other HI lines 34 are on the same face of the substrate (principal plane PL) as the buried segments of lines.

The upper face 13 can also exhibit a ground plane hollowed out around the metallized patches 82.

Figure 9A:
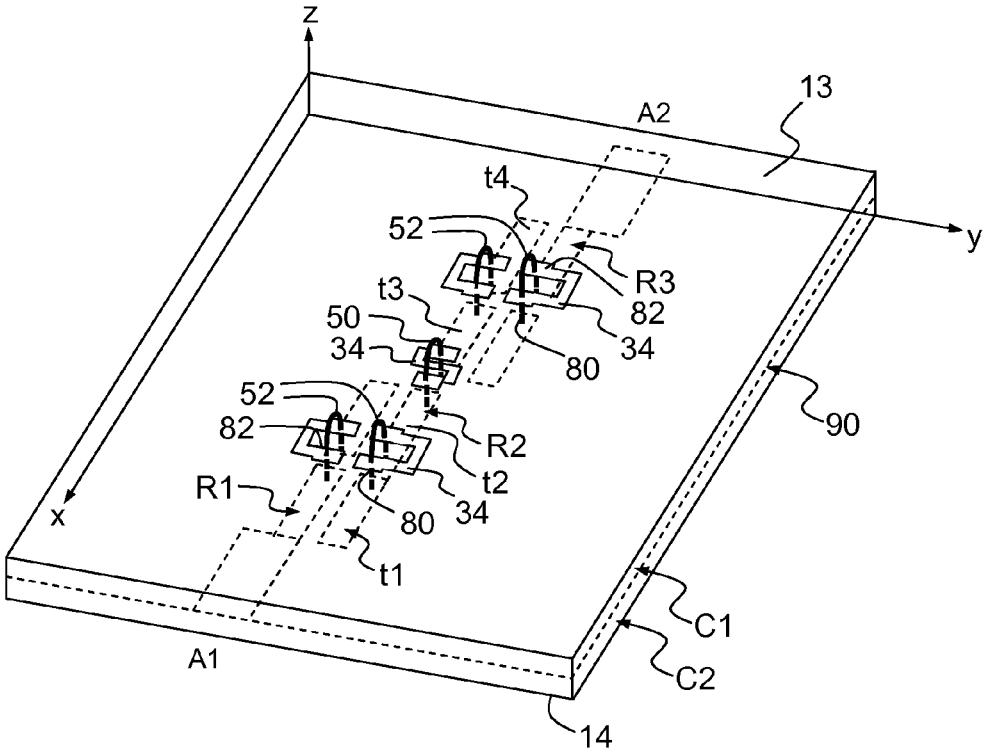
FIG. 9*a*, shows another variant embodiment of the adjustable filter of FIG. 8*a;*

FIG. 9*a*, shows another variant embodiment of the adjustable filter of FIG. 8*a* on a multilayer substrate.

Figure 9B:
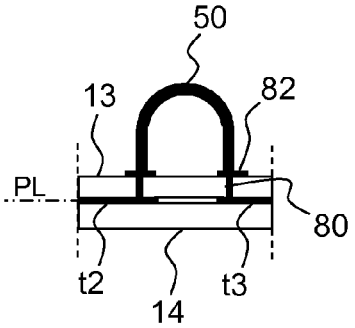
FIG. 9*b* shows a cross-sectional partial view at the level of the central part of the resonator R2 of the filter of FIG. 9*a*.

FIG. 9*b* shows a cross-sectional partial view at the level of the central part of the resonator R2 of the filter of FIG. 9*a*.

Figure 9C:
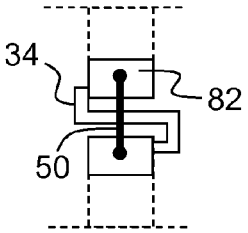
FIG. 9*c* shows a plan view at the level of the central part of the resonator of the filter of FIG. 9*a*.

FIG. 9*c* shows a plan view at the level of the central part of the resonator of the filter of FIG. 9*a*.

In the case of the filter of FIG. 9*a* the other HI lines 34 are produced with the metallized patches 82 on the upper face 13 of the multilayer substrate 90, the metallized patches and the other HI lines 34 are linked to the ends of the buried segments of transmission lines by the metallized holes 80 in the layer C1.

In the case of a filter integrated in a multilayer substrate, it is possible to alter adjustment elements ER on the upper part of the stack of layers of the substrate so as to alter the response of the filter as near as possible to the expected result. This alteration being done this time by laser-based modification or else by etching, after having characterized the inaccessible part of the filter.

The principal part of the filter being shrouded and already produced, the uncertainties in the production of the complementary upper part have a very restricted effect on the final result.

This upper part can notably be exploited to produce and alter transverse couplings between non-adjacent resonators and thus introduce and control additional transmission zeros ZT.

The technique proposed in this invention makes it possible to achieve fine alterations, on structures of filters consisting of planar transmission lines.

The ground planes are not represented in FIGS. 1, 2, 3, 4*a*, 4*b*, 4*c*, 4*d*, 5, 6, 7, 8*a*, 8*b*, 8*c*, 9*a*, 9*b*, 9*c*, which illustrate the examples of filters. Depending on case, there may be a single ground plane situated just below the first substrate (case of the microstrip lines), or else some distance below the latter (suspended microstrip case). There may also be a second ground plane above the structure, for example on the upper face of the upper substrate (6), open around the elements which must remain accessible.

The planar filter and its method of adjustment according to the invention comprises the following advantages:

management of fabrication efficiency problems related to the fabrication tolerances and to the tolerances of the electrical characteristics of the materials, the production of complex hybrid sub-assemblies with integrated filters, without the performance of these filters penalizing the efficiency of fabrication of the whole assembly, the production of filters with very high-performance materials or methods, such as high-permittivity substrates or complex stacks of substrates which are impacted by significant tolerances in their dimensions and in the properties of the materials.

This technique relies on conventional fabrication means in microelectronics: Laying of bonding wires and/or conducting strips of controlled unfurled length and positions. The response of the filter is altered by varying the dimensions and the points of attachment of the bonding wires and/or conducting strips.

This adjustment technique is well suited to large production volumes since it can be completely automated. It makes it possible:

to alter the response of the filter as near as possible to the need with very low residual dispersions related to the materials and to production.

to alter the filtering in situ, that is to say as a function of the characteristics of its environment, or indeed as a function of several applications (several filtering functions achievable on the basis of one and the same structure).

Moreover, by finalizing the response of the filter after integration of the assembly, the sub-contractor is freed (in the first part of production) from possible confidentiality constraints in the case of the production of classified equipment.

The impedance breaks effected in the resonators afford additional degrees of freedom which make it possible to act on the frequency response with more possibilities. This can lead to a smaller number of resonators relative to a conventional non-adjustable structure.

The invention claimed is:

1. An adjustable radiofrequency filter in planar technology comprising:

a dielectric substrate and n resonators R1, R2, . . . Ri, . . . Rj, . . . Rk, . . . Rn integrated into the substrate, wherein each resonator comprises, on a principal plane PL of the substrate, a succession of referenced segments t1, t2, . . . tq, . . . tp of planar transmission lines each having two ends, p being the number of segments of planar transmission lines of the resonator Ri considered, p being equal to or greater than 2, q being a reference to the segment, an end of a segment tq of a resonator Ri being opposite and separated by a distance d from an end of the next segment t(q+1) of the same resonator Ri, the opposite ends of the successive segments of a resonator Ri being linked by an electrical link which locally raises the characteristic impedance of the resonator Ri considered, said electrical link comprising an adjustable element placed between two segment ends of a resonator excluding ends of said resonator.

2. The radiofrequency filter as claimed in claim 1, wherein the electrical link between two successive segments of transmission lines tq, t(q+1) of the resonators R1, R2, . . . Ri, . . . Rj, . . . Rk, . . . Rn is a planar high impedance transmission line of greater characteristic impedance than the characteristic impedance of the resonator Ri considered.

3. The radiofrequency filter as claimed in claim 2, wherein a length of at least one planar high impedance transmission line is larger than the distance d between the opposite ends of two successive segments of transmission lines tq, t(q+1) so as to increase an electric length of the resonators R1, R2, . . . Ri, . . . Rj, . . . Rk, . . . Rn.

4. The radiofrequency filter as claimed in claim 1, wherein the electrical link of the successive segments of transmission lines comprises at least one bonding wire, located in a plane P perpendicular to the principal plane PL of the substrate.

5. The radiofrequency filter as claimed in claim 4, wherein the electrical link between two successive segments of transmission lines tq, t(q+1) of the resonators R1, R2, . . . Ri, . . . Rj, . . . Rk, . . . Rn comprises several adjustment elements in parallel, each adjustment element being located in a respective plane perpendicular to the principal plane PL.

6. The radiofrequency filter as claimed in claim 4, wherein the ends linked by an adjustment element of two successive segments of transmission lines tq, t(q+1) of a resonator Rj are in proximity to the ends of two other successive segments of transmission lines linked by another adjustment element of another resonator Rk in such a way that the surfaces formed by the adjustment elements of the two said resonators Rj and Rk with the principal plane PL are facing one another in order to obtain a coupling between the two resonators Rj and Rk.

7. The radiofrequency filter as claimed in claim 1, wherein the substrate comprises several layers, the principal plane PL comprising the segments of transmission lines of the resonators being between at least two superposed layers.

8. The radiofrequency filter as claimed in claim 1, in which the electrical link comprises at least one micro-wired conducting strip, in a plane P perpendicular to the principal plane PL of the substrate.

9. The radiofrequency filter as claimed in claim 1, in which the electrical link comprises at least a high impedance line connected in parallel with at least one adjustment element.

10. The radiofrequency filter as claimed in claim 1, in which the adjustment element is of adjustable length.

11. The radiofrequency filter as claimed in claim 1, in which the adjustment element is of adjustable position.

12. A method for adjusting an adjustable filter in planar technology comprising a dielectric substrate and n resonators R1, R2, . . . Ri, . . . Rj, . . . Rk, . . . Rn integrated into the substrate, each resonator comprising, on a principal plane PL of the substrate, a succession of referenced segments t1, t2, . . . tq, . . . tp of planar transmission lines each having two ends, p being the number of segments of planar transmission lines of the resonator Ri considered, p being equal to or greater than 2, q being a reference to the segment, an end of a segment tq of a resonator Ri being opposite and separated by a distance d from an end of the next segment t(q+1) of the same resonator Ri, the opposite ends of the successive segments of a resonator Rq being linked by a planar high impedance transmission line intended to locally raise the characteristic impedance of the resonator Ri considered, the method further comprising:

at least one step of bonding, between the opposite ends of two successive segments of transmission lines tq, t(q+1) to terminals of the planar high impedance transmission lines, at least one adjustment element, in a plane P perpendicular to the principal plane PL of substrate, the lengths of the adjustment elements and points of connection thereof on the ends of the segments of transmission lines having been previously determined to obtain the desired resonant frequency of the resonators, said electrical link comprising an adjustable element placed between two segment ends of a resonator excluding ends of said resonator.

13. The method for adjusting a radiofrequency filter as claimed in claim 12, the adjustable filter being a bandpass filter comprising at least one resonator Rj and one resonator Rk, the resonator Rj having the opposite ends of two consecutive segments of transmission lines tq, t(q+1) linked by an adjustment element in proximity to the ends of two other consecutive segments of transmission line of the other resonator Rk linked by another adjustment element, in such a way that the surfaces formed by said adjustment element with the principal plane PL of the two said resonators Rj and Rk are facing one another, the method of adjustment further comprising modifying the distance and the position between one and the other adjustment element of the respective resonators Rj and Rk so as to obtain, by modifying the coupling between the resonator Rj and the resonator Rk, the desired passband.

14. The method for adjusting a radiofrequency filter as claimed in claim 12, in which the at least one adjustment element is a bonding wire.

15. The method for adjusting a radiofrequency filter as claimed in claim 12, in which the at least one adjustment element is a micro-wired conducting strip.

16. The method for adjusting a radiofrequency filter as claimed in claim 12, in which the at least one planar high impedance transmission line has a length which is larger than a distance d between the opposite ends of two successive segments of transmission lines tq, t(q+1) so as to increase an electric length of the resonators R1, R2, . . . Ri, . . . Rj, . . . Rk, . . . Rn.

* * * * *